US005390816A

United States Patent [19]

Boyd

[11] Patent Number: 5,390,816

[45] Date of Patent: Feb. 21, 1995

[54] DINING PLATE HELPER

[76] Inventor: Gary L. Boyd, 328 Sneath Way, Alpine, Calif. 91901

[21] Appl. No.: 113,758

[22] Filed: Aug. 31, 1993

[51] Int. Cl.[6] ..... A47G 19/02

[52] U.S. Cl. ..... 220/574.1; 220/608; 206/511

[58] Field of Search ..... 220/729, 737, 608, 609, 220/574, 574.1; 206/506, 509, 511, 515, 519

[56] References Cited

U.S. PATENT DOCUMENTS

| | | | |
|---|---|---|---|
| D. 58,200 | 6/1921 | Sailer | 220/574 |
| 1,718,668 | 6/1929 | Smythe | 220/608 |
| 2,036,572 | 4/1936 | Frost | 220/608 |
| 3,347,411 | 10/1967 | Kalata et al. | 206/519 |
| 3,405,858 | 10/1968 | Collie | 220/608 |
| 3,422,986 | 1/1969 | Tilseth | 220/574.1 |
| 4,116,355 | 9/1978 | Munn et al. | 220/574 |
| 5,082,140 | 1/1992 | Swenson | 220/574 |
| 5,172,826 | 12/1992 | Celaya | 220/574.1 |
| 5,176,282 | 1/1993 | Rapaz | 220/574 |

*Primary Examiner*—S. Castellano

[57] ABSTRACT

A new and improved dining plate helper in the form of an upstanding annular shaped abutment located on the food containing surface of the plate inwardly with respect to the plate's peripheral edge. On the opposite side of the plate are contained one or more protruding members to serve as legs enabling a series of plates to be stored one on top of another in a stacking arrangement. In an alternative embodiment, additional food retaining members are located on the surface of the plate in a radially aligned circumferentially spaced manner. In yet another alternative embodiment, the plate includes a utensil retaining rim and the protruding member on the opposite side thereof permitting stacking of a plurality of similar plates defines a shallow bowl for retaining a liquid such as soup.

3 Claims, 4 Drawing Sheets

DINING PLATE HELPER

BACKGROUND OF THE INVENTION

1. Field of the Invention

The present invention relates generally to food utensils, and more particularly, to a dining plate having means thereon to facilitate the handling of food with an auxiliary utensil.

2. Description of the Prior Art

It is generally known to provide attachments to dinner plates which serve as abutment members against which food my pushed by a utensil, such as a fork, to facilitate placing the food on the utensil. For example, U.S. Pat. No. 3,422,986 discloses a resilient molded plastic member adapted to snap-fitted on the rim of a conventional dinner plate to serve as an abutment against which food may be urged eventually to be scooped up with a fork or similar utensil. Similarly, U.S. Pat. No. 3,598,278 discloses a ring of somewhat flexible material having a V-shaped cross-section adapted to be fitted on the rim of a standard dinner plate. The rim so fitted serves as a bumper retaining food on the plate. While these prior patented devices generally are directed at solving the problem of retaining food on the surface of plate so that a utensil might more efficiently remove food from the plate's surface, they suffer from substantial drawbacks. Thus, the prior devices are not structurally integrated with the plate and must be fitted about the rim thereof. This requires additional pieces of equipment increasing the chance that the food retaining device might easily be misplaced and in any event, requires extra storage space. In addition, the removable retainers of the prior art must be resilient so that they may be snap-fitted on the rim of plate. This requires, in turn that they be made of a rubbery or plastic material (i.e. not ceramic) which many users find offensive or inelegant when brought into contact with food. Moreover, the rim fitting devices of the prior art, must be removed to enable the dinner plates with which they are used to be cleaned and then conveniently stacked one on top of another for storage when not in use.

It is apparent from the foregoing prior art known to applicant, that a long standing need exists for a dinner plate which includes as an integral part of the structure thereof a device for helping food to be transferred from the plate's surface to a utensil and which furthermore, enables several such similar plates to be conveniently stacked one upon another for easy storage when not in use. Such a need is completely fulfilled by the present invention. Many additional advantages of the present invention over the prior art will be rendered evident.

SUMMARY OF THE INVENTION

To achieve the foregoing and other advantages, the present invention, briefly described, provides a new and improved dining plate helper in the form of an upstanding annular shaped abutment located on the food containing surface of the plate inwardly with respect to the plate's peripheral edge. On the opposite side of the plate are contained one or more proreading members to serve as legs enabling a series of plates to be stored one on top of another in a stacking arrangement. In an alternative embodiment, additional food retaining members are located on the surface of the plate in a radially aligned circumferentially spaced manner. In yet another alternative embodiment, the plate includes a utensil retaining rim and the protruding member on the opposite side thereof permitting stacking of a plurality of similar plates defines a shallow bowl for retaining a liquid such as soup.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining the preferred embodiment of the invention in detail as required by statute, it will be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved dining plate helper has all of the advantages of the prior art and none of the disadvantages.

It is another object of the present invention to provide a new and improved dining plate helper may be easily and efficiently manufactured and marketed.

It is a further object of the present invention to provide a new and improved dining plate helper which is of durable and reliable construction.

An even further object of the present invention is to provide a new and improved dining plate helper which is susceptible of a low cost of manufacture with regard to both materials and labor, and which accordingly is then susceptible of low prices of sale to the consuming public, thereby making such dining plate helper readily available to the buying public.

Still yet a further object of the present invention is to provide a new and improved remote dining plate helper which provides means for facilitating the removal of food from a plate's surface by a utensil such as a fork, spoon, or knife.

Still another object of the present invention is to provide a new and improved dining plate helper which is formed integrally with the plate and of the same material thereof.

Yet another object of the present invention is to provide a new and improved dining plate helper that enables s multiplicity of similar plates to be stacked one on top of another for storage.

Yet still another object of the present invention is to provide a new and improved dining plate helper that includes axillary means for retaining a dining utensil on the plate.

Yet an even further object of the present invention is to provide a new and improved dining plate helper which has means for both facilitating a stacking arrangement among similar plates and for providing an auxiliary plate surface for food.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there arc illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
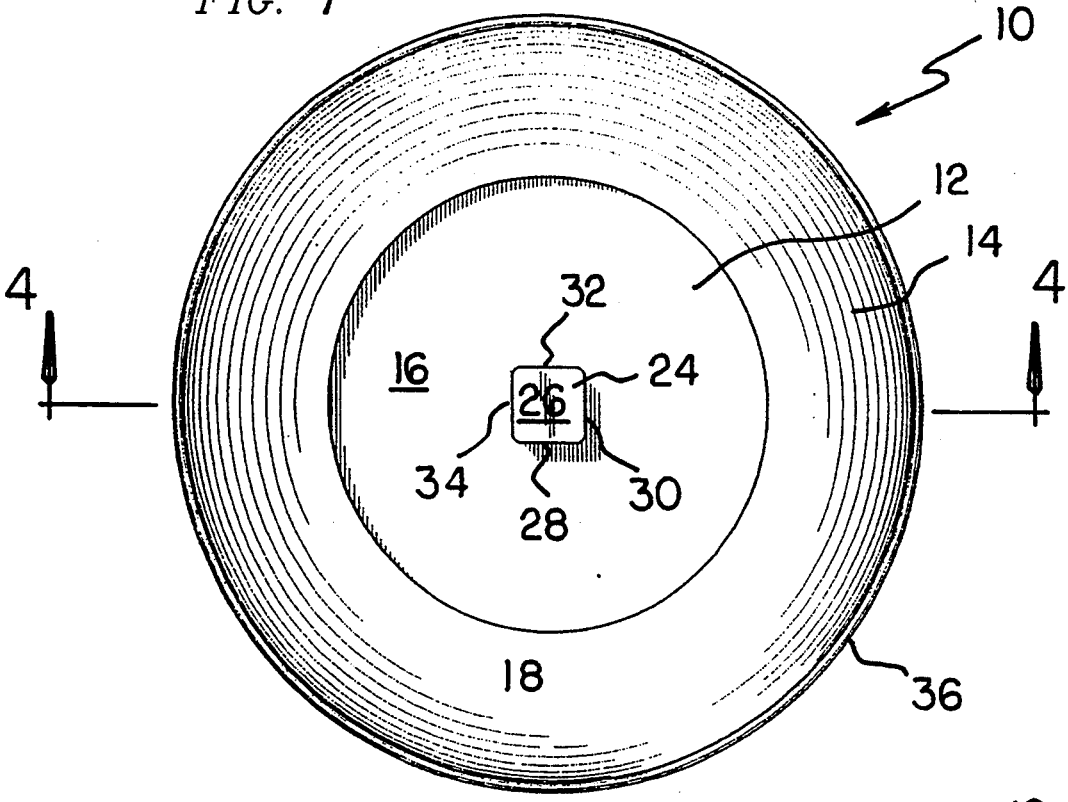
FIG. 1 is a plan view of a first preferred embodiment of the invention showing the top surface thereof.
Figure 2:
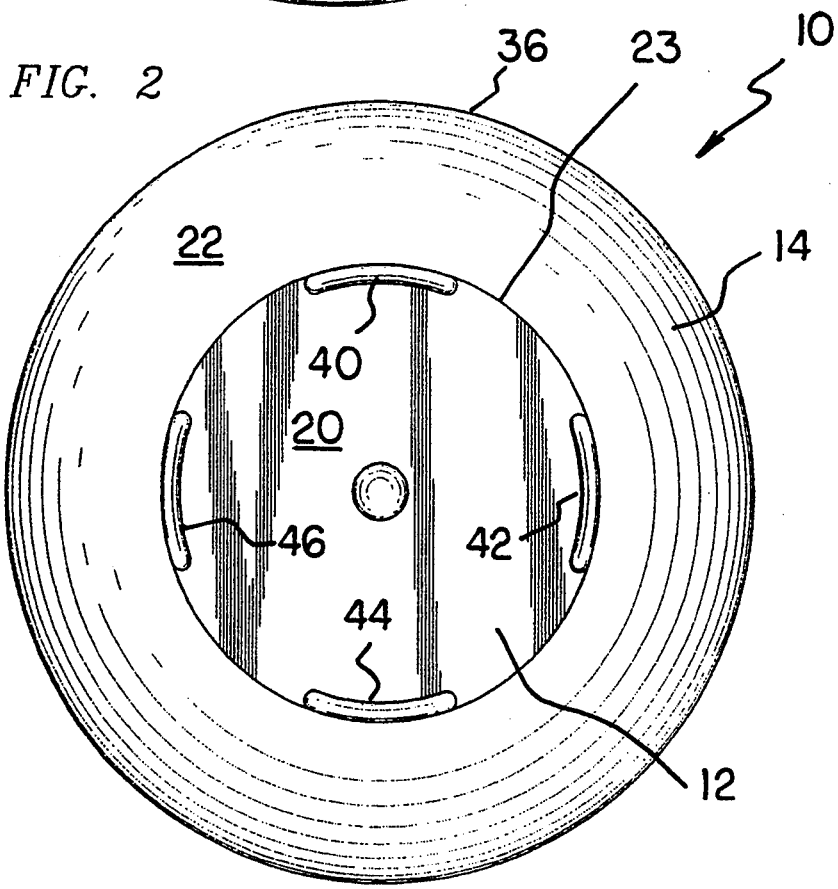
FIG. 2 is a plan view of the first preferred embodiment of the invention showing the bottom surface thereof.
Figure 3:
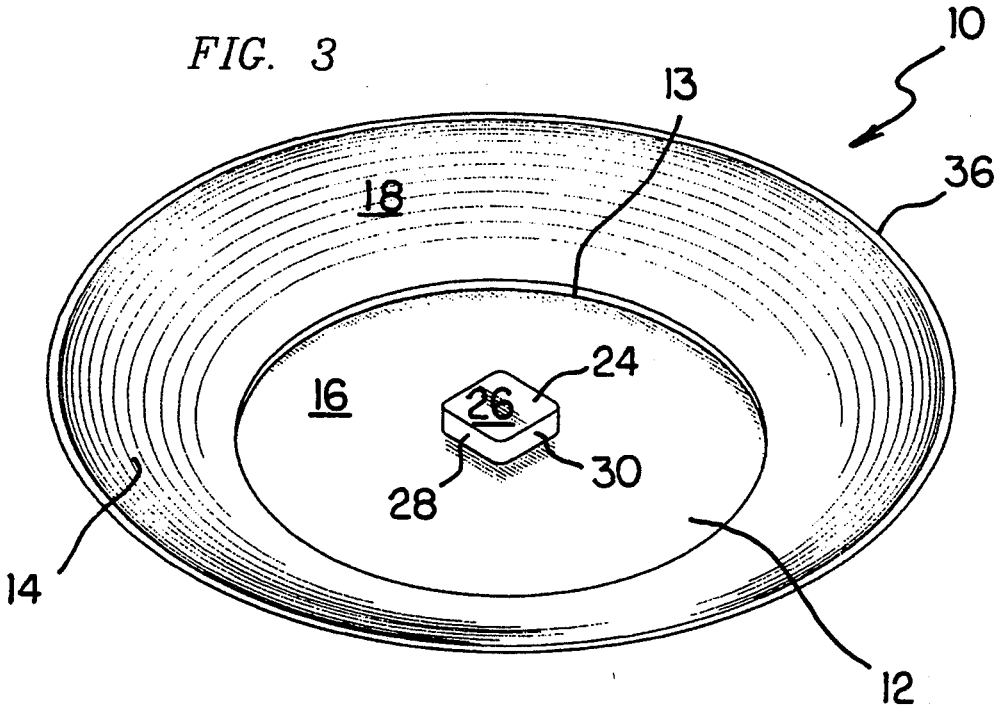
FIG. 3 is a perspective view from above showing the preferred embodiment of FIGS. 1 and 2.

With reference to the drawings, the new and improved dining plate helper embodying the principles and concepts of the present invention now will be described in greater detail as required by statute.

Turning initially to FIGS. 1 through 4 there is shown an exemplary embodiment of the dining plate helper of the invention generally designated by reference numeral 10. In its preferred form, dining plate helper 10 comprises a annular member having an inner portion 12 and an integral outer rim portion 14 radially and circumferentially extending relative to the central axis of the inner portion 12.

Figure 4:
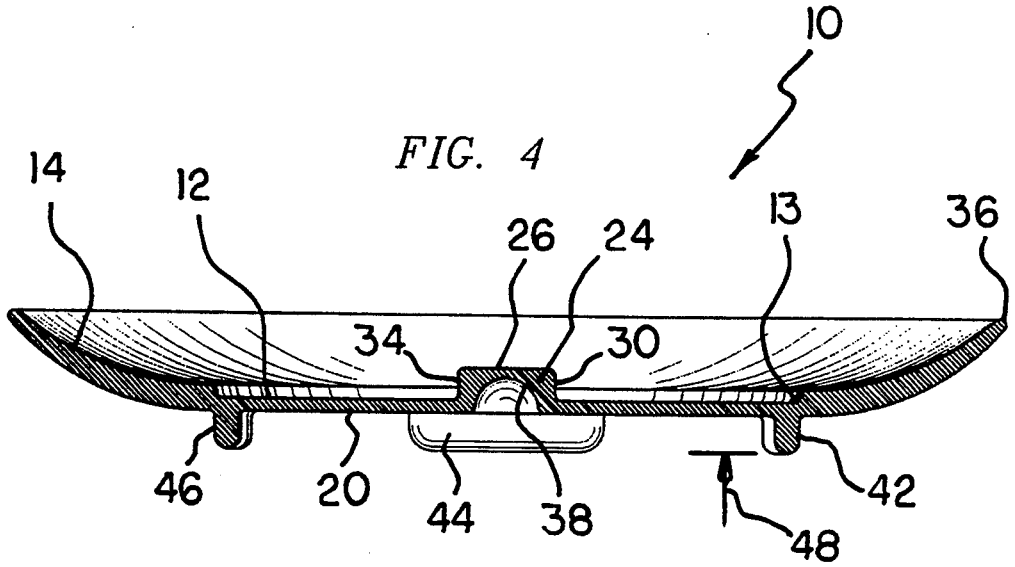
FIG. 4 is a cross-sectional view in elevation taken along line 4—4 of FIG. 1.

As best seen in FIG. 4, inner portion 12 is relatively flat whereas outer rim portion 14 curves upwardly to form a concave or shallow dished structure. In addition, the top surface 16 of inner portion 12 is slightly recessed relative to the top surface 18 of the outer rim portion thereby defining a shoulder 13 demarcating the annular juncture between the inner portion and the outer portion. Similarly, on the underside of the annular member, the bottom surface 20 of inner portion 12 is relatively flat whereas the bottom surface 22 of the outer rim portion is convex substantially as shown. A circumferentially extending edge 23 demarcates the flat under surface 20 of inner portion 12 from the convex undersurface 22 of outer rim portion 14.

In accordance with the invention, an integral upstanding abutment member 24 preferably of square shape (but not necessarily) is positioned coaxially with respect to the central axis of inner portion 12 and has a substantially flat top surface 26 and orthogonally related, substantially flat side walls 28, 30, 32, and 34. It will be noted (FIG. 4) that in its preferred form, flat top surface 26 is elevated to an extent above surface 16, but below the outer circumferential edge 36. The underside of abutment member 24 is characterized by a concave or recessed surface 38 to reduce weight; however, it will be appreciated that such recess is optional.

Extending orthogonally and downwardly from the undersurface 20 of inner portion 12 are a series of protruding leg members 40, 42, 44 and 46. Each leg member is arcuately shaped with a rounded bottom edge and are evenly spaced each with respect to the others proximal to circumferential edge substantially as depicted. The longitudinal extent or height of each leg member 40 through 46 is indicated by arrow 48 in FIG. 4 and this dimension is slightly greater in magnitude than the height of abutment member 24 (i.e. surface 26) with respect to surface 16. By this arrangement, and in accordance with an important feature of the present invention, two or more similar plates 10 may be stacked one on top of another with the rounded bottom edges of the leg members of the top plate resting on surface 16 of the next lowest plate and with the radially outside surface of each leg member being proximal to shoulder 13. In addition, when the plates are so positioned in such a stacked arrangement, the bottom surface 20 of inner portion 12 will be slightly elevated above the top surface 26 of the abutment member on the plate immediately below it in the stacked arrangement, and thus will not interfere with the abutment member on the next lower plate. It will be appreciated therefore, that by virtue of the unique construction described above, a multiplicity of similar plates conveniently may be stacked one above the other in a secure nesting arrangement when not in use.

In operation, food on the upper surface of the dining plate helper 10 may be scooped against the upstanding abutment member 24 with a utensil such as a spoon, knife or fork; or by other food, such as a piece of bread, to assist in the removal of the food from the plate without using one's fingers as will be apparent without further discussion.

Figure 5:
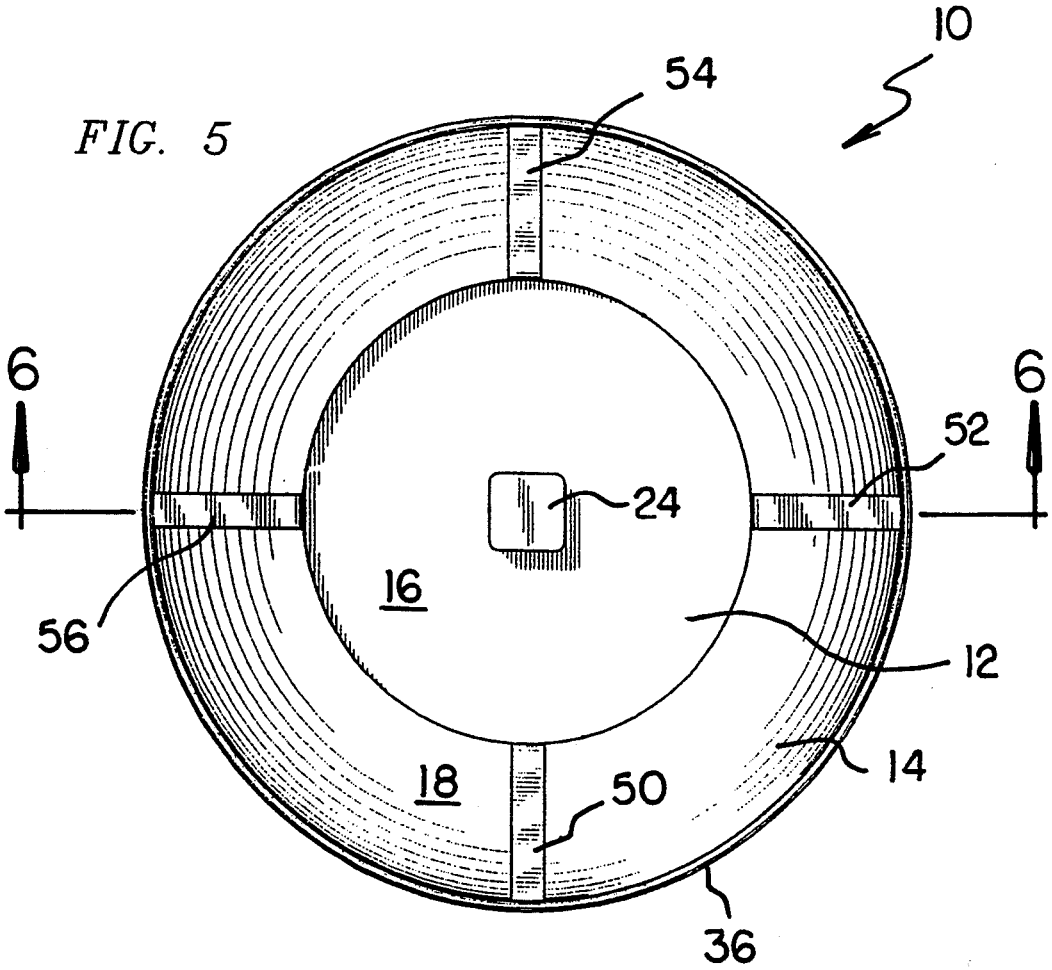
FIG. 5 is a plan view of a second preferred embodiment of the invention showing the top surface thereof.
Figure 6:
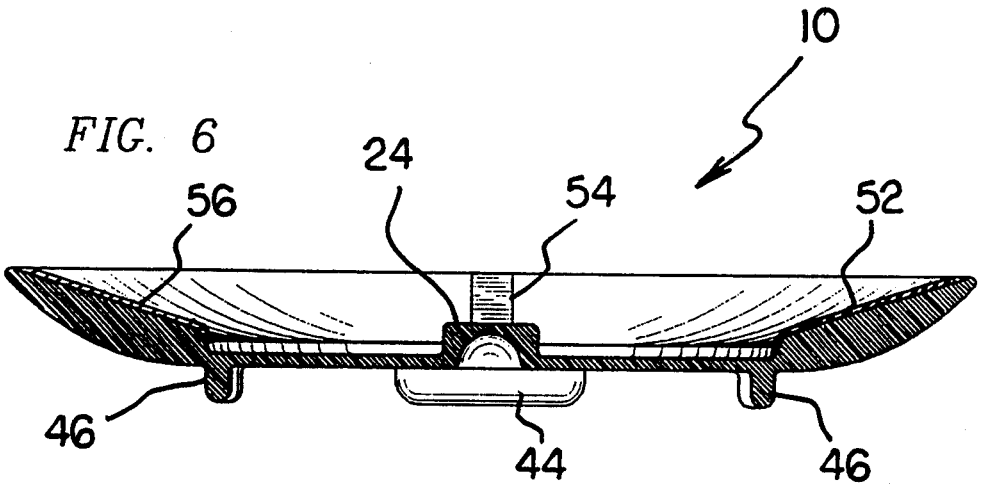
FIG. 6 is a cross-sectional view in elevation taken along line 6—6 of FIG. 5.

Turning now to FIGS. 5 and 6 wherein like reference numerals represent like parts, there is shown an alternatively preferred embodiment of the invention. A multiplicity of auxiliary abutment members 50, 52, 54, and 56 in the form of radial ribs preferably evenly spaced circumferentially with respect to each other are integrally formed on the top surface of the outer rim portion substantially as shown. Since ribs 50 through 56 are located only in the outer rim portion 14, they have no adverse effect on the ability of the plates to be placed in the stacking arrangement described above with respect to FIGS. 1 through 4.

Figure 7:
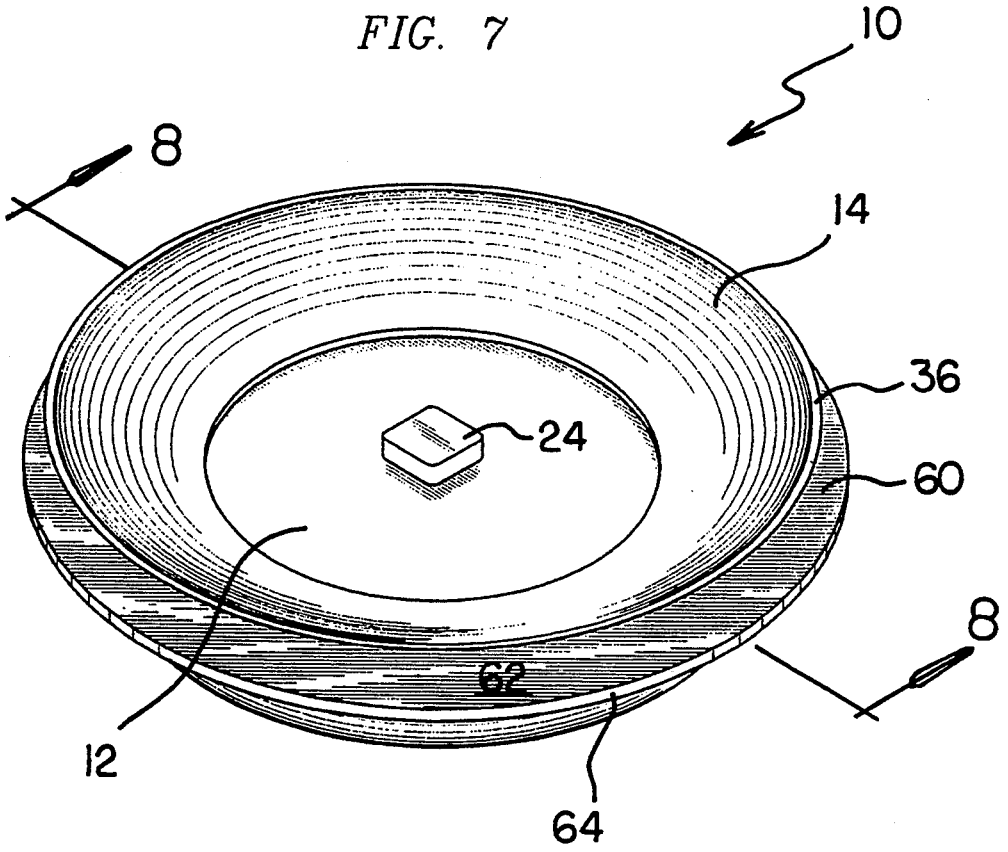
FIG. 7 is a perspective view from above showing a third alternatively preferred embodiment of the invention.
Figure 8:
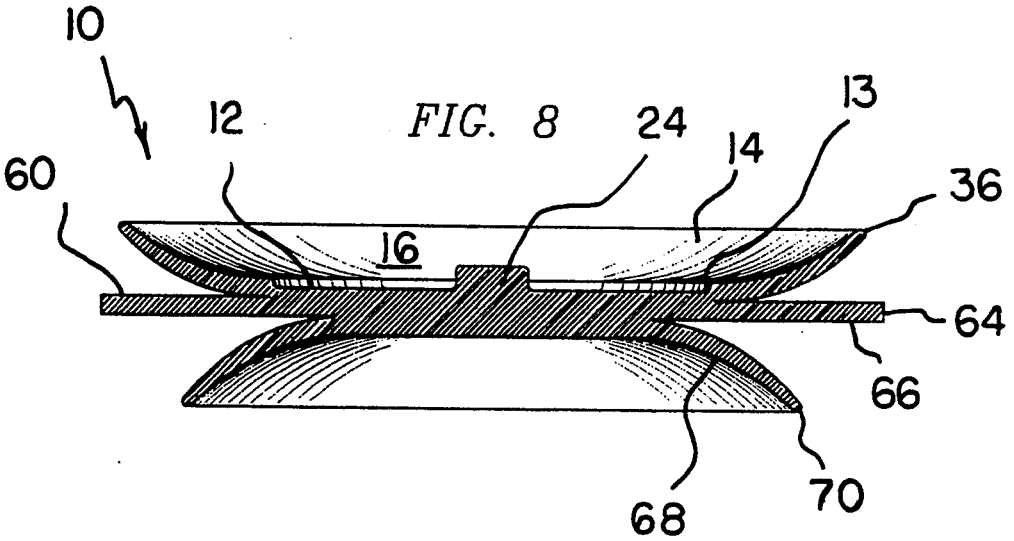
FIG. 8 is a cross-sectional view in elevation taken along line 8—8 of FIG. 7.

FIGS. 7 and 8 show yet a further preferred embodiment of the invention where again like reference numerals represent like parts. As illustrated, an auxiliary annular rim portion 60 is provided extending radially from the under surface 20 of inner portion 12 to define a horizontal retaining ledge or surface 62 for the placement of utensils such as a knife, fork, spoon, etc. In this regard it will be noted that the peripheral edge 64 of rim portion 60 extends radially beyond peripheral edge 36 of outer rim portion 14. Protruding downwardly from the undersurface 66 of the radially extending annular rim portion 60 is an integral bowl portion 68 inverted with respect to the top of plate 10 and which serves a dual purpose.

First, auxiliary bowl portion 68 which defines a concavity deeper than the concavity defined by the top surface of the plate may be used when inverted with respect to its position shown in FIGS. 7 and 8 as an auxiliary food surface such as a soup bowl, for example.

Second, bowl portion 68 has a diameter less than that of the top outer portion 14 of plate 10, and therefore, the peripheral edge 70 of bowl portion 68 defines a circumferential engagement surface permitting two or more similar plates to be stacked with edge 70 of the top plate engaging the top surface 16 of outer portion 14 of the next lower plate since edge 70 extends radially beyond shoulder 13. In addition since the concavity of bowl portion 68 is deeper than the concavity defined by the top of the plate, it is apparent that there will be no interference between abutment member 24 and the bottom flat surface of auxiliary bowl portion 68 when the plates of FIGS. 7 and 8 are stacked in accordance with the invention as described above in connection with the embodiments of FIGS. 1 through 6.

It will be understood that the novel dining plate helper described above in its preferred forms may be varied without departing from the principles of the invention. Thus, although the preferred material for plate 10 is a conventional ceramic material commonly used for dining plates, any suitable other material may be used instated including, but not limited to plastic, paper, wood, or metal. Further, although abutment 24 is shown having a square shape, any suitable other shape such as rectangular, cylindrical, triangular, conical or domed may be used instead. Additionally, with respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many additional modifications thereof may be made without departing from the principles and concepts set forth herein. Hence, the proper scope of the present invention should be determined only by the broadest interpretation of the appended claims so as to encompass all such additional modifications and equivalents.

What is claimed as being new and desired to be protected by LETTERS PATENT of the United States is as follows:

1. A dining plate comprising:

an annular member including a substantially flat inner portion of a first thickness and having a substantially circular shape defining an inner portion periphery therearound of an inner portion diameter, with said inner portion having a substantially flat inner portion top surface and a substantially flat inner portion bottom surface, said inner portion being operable to receive food thereon for manipulation and dissection of said food with a utensil by an individual, said inner portion further having an integrally formed upstanding abutment member positioned in a center of said inner portion top surface, said abutment member having a top surface and a side wall surface, said side wall surface being operable to engage said food when said food is moved across said inner portion by said utensil operated by said individual, thereby stopping said food from further traversing said inner portion and forcing said food onto said utensil, said abutment member having an abutment member height defined by a distance between said abutment member top surface and said inner portion top surface from which said abutment member upwardly projects;

said annular member further including an annular outer rim portion integrally extending from said inner portion periphery, said outer rim portion being of a second thickness greater than said first thickness such that an annular shoulder is defined along said inner portion periphery on said inner portion top surface at a juncture of said outer rim portion and said inner portion with said inner portion being substantially recessed relative to said outer rim portion, said outer rim portion having an outer rim portion top surface and an outer rim portion bottom surface, said outer rim portion being substantially convex along said bottom surface thereof and substantially concave along said top surface thereof such that said food will be gravitationally biased from said rim portion towards said inner portion when said annular member is positioned substantially horizontally;

said annular member further including a plurality of integrally formed leg members extending from said inner portion bottom surface at said juncture of said outer rim portion and said inner portion, said leg members each being substantially arcuately shaped so as to be aligned along a corresponding portion of said inner portion periphery, said leg members each having an outside sur#ace and a leg member height defined as a distance from which the leg members project from said inner portion bottom surface with said leg member height being substantially slightly greater than said abutment member height, said leg members being arcuately spaced from each other along said upper portion periphery such that said dining plate can be stacked onto another substantially identically constructed dining plate with said leg members of said dining plate abutting said annular shoulder of said another dining plate to preclude sliding of said dining plate relative to said another dining plate.

2. The dining plate as recited in claim 1, wherein said inner portion bottom surface includes an integrally formed concave recessed surface positioned in a center area thereof and extending through said inner portion and at least partially into said abutment member.

3. The invention of claim 1 wherein said annular outer rim portion further comprises at least one radially extending rib on said top surface.

* * * * *